US010632737B2

(12) United States Patent
Billing et al.

(10) Patent No.: US 10,632,737 B2
(45) Date of Patent: Apr. 28, 2020

(54) APPARATUS FOR FLEXOGRAPHIC PRINTING AND AN INLET MODULE

(71) Applicant: Tetra Laval Holdings & Finance S.A., Pully (CH)

(72) Inventors: Tobias Billing, Dösjebro (SE); Mårten Scheffler, Staffanstorp (SE)

(73) Assignee: Tetra Laval Holdings & Finance S.A., Pully (CH)

( * ) Notice: Subject to any disclaimer, the term of this patent is extended or adjusted under 35 U.S.C. 154(b) by 0 days.

(21) Appl. No.: 16/064,896

(22) PCT Filed: Dec. 15, 2016

(86) PCT No.: PCT/EP2016/081299
§ 371 (c)(1),
(2) Date: Jun. 21, 2018

(87) PCT Pub. No.: WO2017/108589
PCT Pub. Date: Jun. 29, 2017

(65) Prior Publication Data

US 2019/0001661 A1 Jan. 3, 2019

(30) Foreign Application Priority Data

Dec. 22, 2015 (SE) ..... 1551710

(51) Int. Cl.
*B41F 31/02* (2006.01)
*B41F 13/18* (2006.01)
*B41F 31/04* (2006.01)

(52) U.S. Cl.
CPC ..... *B41F 31/027* (2013.01); *B41F 13/18* (2013.01); *B41F 31/04* (2013.01); *B41P 2200/12* (2013.01)

(58) Field of Classification Search
CPC ..... B41F 31/20; B41F 31/08; B41F 31/02; B41F 31/022; B41F 31/027
See application file for complete search history.

(56) References Cited

U.S. PATENT DOCUMENTS 5,826,509 A 10/1998 Deneka
2006/0081141 A1* 4/2006 Deneka ..... B41F 31/027 101/366

(Continued)

FOREIGN PATENT DOCUMENTS

DE 3220537 A1 12/1983
DE 19516223 A1 11/1996

(Continued)

OTHER PUBLICATIONS

Allison Bailes, "The Secret to Moving Air Efficiently through Your Duct System", https://www.energyvanguard.com/blog/secret-moving-air-quietly-through-your-duct-system, Aug. 2015 (Year: 2015).*

(Continued)

*Primary Examiner* — Judy Nguyen
*Assistant Examiner* — Quang X Nguyen
(74) *Attorney, Agent, or Firm* — Knobbe, Martens, Olson & Bear, LLP

(57) ABSTRACT

The present disclosure relates to an apparatus for flexographic printing of a web of packaging material with printing ink and an inlet module for a flexographic printing apparatus. The apparatus may include an ink pan or chamber, and an anilox roll rotary at least partly inside the ink chamber for picking up and transferring printing ink from the ink chamber to an impression cylinder which is rotary in transfer contact with the anilox roll. The ink chamber may be elongated and extend axially along the anilox roll, the ink chamber having a first axial end and a second axial end opposite the first axial end. The apparatus may further include a first printing ink inlet arranged at the first axial end (Continued)

and a second printing ink inlet arranged at the second axial end.

19 Claims, 3 Drawing Sheets

(56) References Cited

U.S. PATENT DOCUMENTS

| | | | | |
|---|---|---|---|---|
| 2007/0289464 | A1* | 12/2007 | Wintersgill | B41F 31/027 101/366 |
| 2014/0060426 | A1* | 3/2014 | Riga, Jr. | B05C 11/04 118/100 |

FOREIGN PATENT DOCUMENTS

| | | | |
|---|---|---|---|
| DE | 102007018132 | A1 | 10/2008 |
| EP | 2251200 | A2 | 11/2010 |
| GB | 2336809 | A | 3/1999 |
| WO | WO 2005/105450 | A1 | 11/2005 |
| WO | WO 2013064415 | | 5/2013 |
| WO | WO 2014/041481 | A1 | 3/2014 |

OTHER PUBLICATIONS

Search Report and Written Opinion for International Application No. PCT/EP2016/081299 dated May 24, 2017 in 11 pages.
Search Report and Written Opinion for International Application No. ITS/SE15/00289 dated Dec. 22, 2015 in 5 pages.

* cited by examiner

APPARATUS FOR FLEXOGRAPHIC PRINTING AND AN INLET MODULE

TECHNICAL FIELD

The present invention generally relates to the field of apparatuses for flexographic printing of a web of packaging material with printing ink, and to an inlet module for a flexographic printing apparatus.

BACKGROUND ART

In general, flexographic printing of a web of packaging material is carried into effect using a thin-running and often volatile printing ink which implies that the printing ink must be transferred from the ink pan or chamber to the packaging material web before it has had time to dry on route. For this transfer, use is therefore made of a hard roll (anilox roll) which displays on its circumferential surface engraved cells with the aid of which printing ink is taken up from the ink pan or chamber and transferred to the printing cylinder rotary in transfer contact with the anilox roll. In order to facilitate taking up of printing ink from the ink chamber, the anilox roll is rotary in direct contact with the printing ink in the ink chamber. The ink chamber is defined upwardly by an upper axial elongate doctor blade in contact with the circumferential surface of the anilox roll, and downwardly by a lower, similarly axially extending doctor blade in contact with the circumferential surface of the anilox roll. The upper doctor blade, which lightly abuts against the circumferential surface of the anilox roll, is intended to scrape off and recycle picked up excess ink before departure from the ink chamber. The lower doctor blade, which lightly abuts against the circumferential surface of the anilox roll, is intended to prevent printing ink from leaking out from the ink chamber.

The ink chamber is filled to a predetermined level with continuously circulating printing ink, via an inlet and an outlet to the ink chamber. The quality of the printing ink is continuously regulated in an external unit, in respect of viscosity and temperature and other properties so that a uniform printing result is obtained. Both of the axial end walls of the ink chamber may, in a prior art apparatus, extend right up to sealing abutment against the circumferential surface of the anilox roll in order to ensure that as little printing ink as possible leaks out laterally from the ink chamber.

According to another prior art example, the end walls are disposed in spaced apart relationship from the surface of the anilox roll, in which event sealing against leakage of printing ink through the thus formed gaps between each respective end wall and the circumferential surface of the anilox roll is catered for by means of an observed relationship between the viscosity of the printing ink and the speed of rotation of the anilox roll during ongoing printing. According to this relationship, there is for each viscosity a speed of rotation above which the tendency of the printing ink to accompany the anilox roll is greater than the tendency of the printing ink to leak out from the ink chamber laterally through the thus formed gaps at the axial end wall. Thus, this prior art embodiment affords the advantage in relation to the previously described embodiment that it requires no frequently recurring operational stoppage for replacement of worn rubber seals. A further advantage is that it causes no wear, or very slight wear, to the anilox roll because of friction heat as described above.

One drawback inherent in this latter described embodiment is however that it not seldom occurs that residual printing ink on the circumferential surface of the anilox roll, after transfer of printing ink to the printing cylinder, dries and adheres to the anilox roll and as a result cannot be scraped off by the doctor blades, but accompanies the anilox roll into the ink pan or chamber when the anilox roll is rotated during operation.

WO2013064415 by the applicant discloses an improved apparatus for flexographic printing of a web of packaging material which has a spray device for applying a cleaning fluid to the anilox roll, and axial end walls of the ink chamber configured as a unit module of two mutually spaced apart end wall elements. This solution, at least, alleviates the above described problems and drawbacks of the flexographic printing apparatuses.

However, there is thus still a desire to improve the state of the art to provide an improved apparatus for flexographic printing of a web of packaging material. For example, it may always be desirable to reduce the energy consumption, and the wear and tear of components as well as improving the printing quality.

SUMMARY OF THE INVENTION

It is an object of the present invention to improve the current state of the art, to alleviate at least some of the above problems, and to provide an improved apparatuses for flexographic printing of a web of packaging material with printing ink.

According to a first aspect of the present invention, an apparatus for flexographic printing of a web of packaging material with printing ink is provided. The apparatus comprises:

an ink chamber; and an anilox roll rotary at least partly inside the ink chamber for picking up and transferring printing ink from the ink chamber to an impression cylinder which is rotary in transfer contact with the anilox roll, wherein the ink chamber is elongated and extends axially along the anilox roll, and the ink chamber has a first axial end and a second axial end opposite the first axial end, characterised in that the apparatus further comprises a first printing ink inlet arranged at the first axial end of the ink chamber and a second printing ink inlet arranged at the second axial end of the ink chamber.

The present invention is based on the realization that a high pressure and/or flow is required in the ink chamber in order to ensure that the printing ink is substantially uniformly distributed over the width of the anilox roll. Otherwise, there will be a lack of ink on towards the ends of the anilox roll, also known as ink starvation. The high pressure and/or flow of ink is typically provided by a pump device. This of course leads to high requirements the pump which continuously refills the ink chamber during operation, and on the seals and/or other components which are to keep the printing ink in the ink chamber. Moreover, due to the high pressure and also flow into the ink chamber, there is froth and/or foam formed within the ink chamber which is detrimental to the ink transfer to the anilox roll. By having two printing ink inlets, one at each axial end of the ink chamber, the pressure along the ink chamber is more uniformly distributed throughout the ink chamber, and the pressure and flow provided by the pump can be reduced. Further, as the pressure and flow is reduced the amount of froth and/or foam formed in the ink chamber is also reduced. Hence, through the invention, both costs for components e.g. the pump can be reduced as well as energy which needs to be supplied to the pump. The reduced pressure may also reduce the requirements on the seals and/or other components which are to keep the printing ink in the ink chamber.

The term printing ink inlet should herein and henceforth be construed as an inlet which supplies printing ink from some sort of printing ink source, such as a printing ink tank or a printing ink reservoir or the like, into the ink chamber. The term ink chamber may also be known in the art as an ink pan.

In at least one exemplary embodiment, the first printing ink inlet and the second printing ink inlet are arranged to direct printing ink at least partly parallel to the axial extent of the anilox roll. Stated differently, the first printing ink inlet is arranged to direct printing ink at least partly towards the second printing ink inlet, and the second printing ink inlet is arranged to direct printing ink at least partly towards the first printing ink inlet. This means that the printing ink inlets direct the printing ink from the respective inlets at least partly towards the center of the ink chamber. Thereby, an improved and more uniform pressure and ink distribution is achieved over the width of the ink chamber. Further, there is a reduced requirement for the sealing function at the axial ends of the ink chamber as there is no flow directed towards axial ends. The width of the ink chamber should be interpreted as measured in the axial extent of the anilox roll. The expression at least partly parallel to the axial extent of the anilox roll means that direction of the printing ink flowing into the ink chamber via the printing ink inlets is at least partly following the rotational axis of the anilox roll, for example being directed parallel with the rotational axis of the anilox roll, or at an angle of 1-89 degrees to the rotational axis of the anilox roll. Preferably, the printing ink inlets direct the printing ink with a deviation of less than 30 degrees from parallel to the rotational axis of the anilox roll.

In at least one exemplary embodiment, each of the first printing ink inlet and the second printing ink inlet has an elongated exit. An elongated exit enables the inlet to be smaller, e.g. thin, in at least one dimension. An exit should be interpreted as an outlet through which printing ink may flow.

In at least one exemplary embodiment, the elongated exit may be elongated in an upright direction. The upright direction should be understood as the vertical direction, or a deviation from a vertical direction of less than 30 degrees. Thereby, the ink chamber may be made smaller, e.g. thinner, as measured in the radial direction from the anilox roll. This may allow other components of an apparatus for flexographic printing of a web of packaging material with printing ink to be arranged closer to the anilox roll and/or the ink chamber. Hence, the apparatus for flexographic printing of a web of packaging material with printing ink may be made more compact.

In at least one exemplary embodiment each of the first printing ink inlet and the second printing ink inlet has an entry with the same cross-sectional area as the exit. This reduces the flow resistance through the inlet, which means that there is less flow resistance for an ink pump to overcome.

In at least one exemplary embodiment, each of the first printing ink inlet and the second printing ink inlet is substantially orthogonal. In order to provide a compact apparatus, the inlets may be orthogonal in order to reduce the width of the ink chamber.

In at least one exemplary embodiment, each of the first printing ink inlet and the second printing ink inlet has a channel extending substantially orthogonal between the entry and the elongated exit.

In at least one exemplary embodiment, the first printing ink inlet is formed in a first inlet module, and wherein the second printing ink inlet is formed in a second inlet module, wherein each of the first inlet module and second inlet module further comprises an anilox roll seal.

An anilox roll seal should be interpreted as two mutually spaced apart end wall elements. The end wall element proximal to the ink chamber prevents lateral leakage of printing ink, and the end wall element distal to the ink chamber prevent printing ink having leaked past the proximal end wall element from leaving the ink chamber. A drainage outlet may be arranged between the end wall elements. Hence, printing ink which, where applicable, leaks out laterally from the ink chamber is collected between the end wall elements is taken care of via an interjacent outlet arranged between the wall elements and is thereby prevented from causing splashing and soiling. The anilox roll seal is preferably manufactured from a rubber or plastic material. The anilox roll seal is also disclosed and discussed in WO2013064415, which portions thereof relating to the anilox roll seal, also known as "unit module", is hereby incorporated by reference.

In at least one exemplary embodiment, the apparatus further comprises a printing ink reservoir, wherein each of the first printing ink inlet and the second printing ink inlet is fluidly connected to the printing ink reservoir via a conduit. Each of the inlets may be separately connected via a conduit to the printing ink reservoir. Alternatively, a T-shaped conduit with only one end at the printing ink reservoir may be used to connect the printing ink reservoir and the printing ink inlets.

In at least one exemplary embodiment, the apparatus further comprises a printing ink pump arranged to, during operation, pump printing ink from the printing ink reservoir to the first printing ink inlet and the second printing ink inlet via the conduit. The printing ink pump may be arranged in the printing ink reservoir or along the conduit. There may be more than one pump if there is a separate conduit from the printing ink reservoir to each of the inlets. The printing ink pump may be any known pump type in the art, and be driven in any known manner such as pneumatic, hydraulic, or electric.

According to at least a second aspect of the present invention, an inlet module for a flexographic printing apparatus is provided. The inlet module comprises a circular entry, an elongated exit, and a channel extending substantially orthogonally between the entry and exit.

Effects and features of this second aspect of the present invention are largely analogous to those described above in connection with the first aspect of the inventive concept. Hence, the inlet module may be used to advantage with a flexographic printing apparatus. Embodiments mentioned in relation to the first aspect of the present invention are largely compatible with the second aspect of the invention, of which some embodiments are explicitly mentioned in the following.

In at least one exemplary embodiment, the circular entry has the same cross-sectional area as the elongated exit.

In at least one exemplary embodiment, the inlet module further comprises an anilox roll seal. In other words, the inlet module may serve at least two purposes: a portion of the sealing mechanism between the ink chamber and the anilox roll as well being an inlet for the printing ink into the ink chamber.

The inlet module may be configured to form a portion of an axial end wall of an ink chamber. The inlet module may be configured to form an entire axial end wall of an ink chamber.

Generally, all terms used in the claims are to be interpreted according to their ordinary meaning in the technical field, unless explicitly defined otherwise herein. All references to "a/an/the [element, device, component, means, step, etc.]" are to be interpreted openly as referring to at least one instance of said element, device, component, means, step, etc., unless explicitly stated otherwise.

BRIEF DESCRIPTION OF THE DRAWINGS

The above objects, as well as additional objects, features and advantages of the present invention, will be more fully appreciated by reference to the following illustrative and non-limiting detailed description of preferred embodiments of the present invention, when taken in conjunction with the accompanying drawings, wherein.

DETAILED DESCRIPTION OF PREFERRED EMBODIMENTS OF THE INVENTION

In the present detailed description, embodiments of an apparatus for flexographic printing of a web of packaging material with printing ink are mainly discussed with reference schematic views showing an apparatus for flexographic printing of a web of packaging material with printing ink and a printing ink inlet according to various embodiments of the invention. It should be noted that this by no means limits the scope of the invention, which is also applicable in other circumstances for instance with other types or variants of apparatuses for flexographic printing of a web of packaging material with printing ink or devices than the embodiments shown in the appended drawings. Further, that specific components are mentioned in connection to an embodiment of the invention does not mean that those components cannot be used to an advantage together with other embodiments of the invention.

Figure 1:
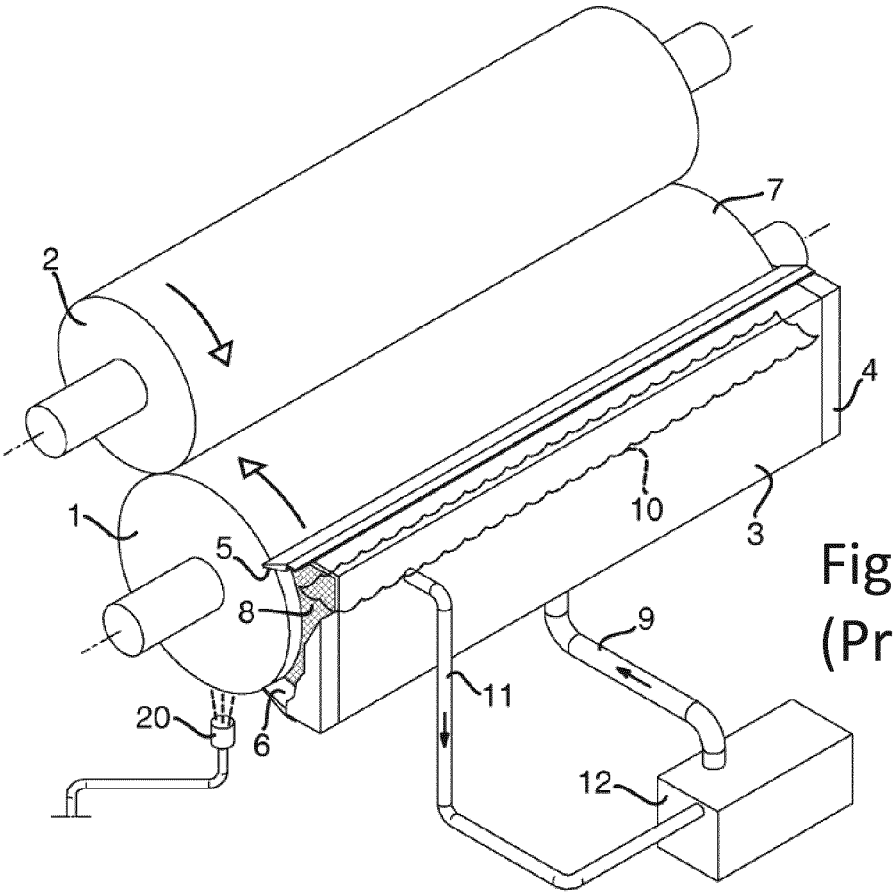
Fig. 1 (Prior art)
FIG. 1 is a perspective view of an apparatus known in the art.
Figure 2:
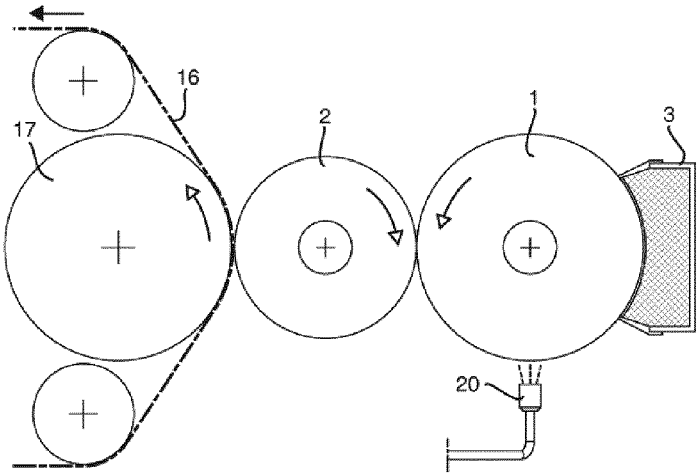
Fig. 2 (Prior art)
FIG. 2 is a schematic side view of an apparatus known in the art for printing of a web of packaging material with printing ink.

FIG. 1 illustrates a known prior art apparatus, disclosed in WO2013064415 which is hereby incorporated by reference, at least with regard to FIGS. 1 and 2, also disclosed therein for understanding the function of the prior art apparatus. The apparatus shown in FIG. 1 has an anilox roll 1, a printing cylinder in the form of an impression plate cylinder 2 (hereinafter designated impression cylinder) and an ink pan or chamber 3, the ink chamber being disposed axially along the one side of the anilox roll 1. The ink chamber 3 is defined by a first chamber wall 4, an upper and a lower doctor blade 5, 6, part of the circumferential surface 7 of the anilox roll 1, as well as by an end wall 8 at each respective axial end of the ink chamber 3. The first chamber wall 4 may be designed as a curved, C-shaped or U-shaped wall or as a planar wall, depending upon the length of the doctor blades 5, 6 employed and depending upon how the doctor blades are fixed at the first chamber wall. Suitably, the wall is designed as an integrated unit in which the doctor blades are secured.

In order to maintain uniform quality and uniform properties of the printing ink, the ink is circulated continuously through the ink chamber 3 by the intermediary of an inlet 9 and fills up the ink chamber to a predetermined level 10, before being led out of the chamber by the intermediary of an outlet 11. The viscosity, temperature and homogeneity of the printing ink are regulated in an external unit 12 (only illustrated schematically), including e.g. agitators and temperature control. It is important that printing ink be transferred to the impression cylinder 2 from the anilox roll 1 in a uniform quantity and with uniform quality, so that no differences occur in printing result between different regions of the printed web. In such instance, the continuous circulation of printing ink monitors and regulates the printing ink in respect of important properties, regardless of whether the printing process is in operation or whether the printing unit for some reason is inoperative. The anilox roll 1 will be constantly kept wet and filled with printing ink and be uniformly coated with ink also in stationary downtime, so that the ink does not dry and occasion problems in later printing processes. The printing ink is led into the ink chamber 3 by the intermediary of an inlet 9 in or close to the bottom of the ink chamber and out of the chamber by the intermediary of an outlet 11 on a level just above the maximum level 10 to which printing ink is intended to be filled in the chamber.

The end wall 8 is disposed such that the edge which faces towards the surface of the anilox roll 1 adheres to the configuration of the anilox roll but at a distance from the circumferential surface 7 of the anilox roll. Between the circumferential surface 7 of the anilox roll 1 and the edge of the end wall 8 there is thus a gap which may have a width of from approximately 0.5 mm to approximately 2 mm, preferably from approximately 0.5 mm to approximately 1.5 mm, most preferably from approximately 0.6 to approximately 1.0 mm.

In use, the rolls and cylinders of the apparatus, including the anilox roll 1, are rotated at a certain minimum speed, the printing ink in the ink chamber forms a liquid film along this gap so that liquid no longer leaks out from the ink chamber 3 through the gap. A preferred gap width for a water-based printing ink which is often used for printing a web of packaging material for liquid foods and which has a viscosity of approximately 20 s is from approximately 0.6 to approximately 0.9 mm.

FIG. 2 schematically illustrates a printing process employing a flexographic printing apparatus known in the art. In FIG. 2, the same reference numerals as earlier have been employed for the same or equivalent parts. The anilox roll 1 is rotated in the direction of rotation of the arrow, partly within the ink chamber 3 positioned axially along the roll 1 for taking up printing ink in the cells engraved on the circumferential surface of the roll 1. Picked up excess ink is scraped off from the roll 1 by an upper doctor blade (obscured in the figure) abutting against the circumferential surface, on exit from the ink chamber 3. The printing ink thus remaining in the engraved cells accompanies the rotating anilox roll 1 and is transferred to an impression cylinder 2 rotating in transfer contact with the anilox roll 1. The printing ink thus transferred to the impression cylinder 2 accompanies the rotating impression cylinder 2 for transfer to a web 16 of packaging material which is led through the nip between the impression cylinder 2 and a counter pressure cylinder 17 rotating adjacent the impression cylinder 2. After drying/setting of the transferred printing ink on the surface of the web, the printed web is rolled up for further processing, such as lamination and mechanical processing in a per se known manner.

In order to maintain good print quality and reduce process-related quality disruptions, but also to minimize unnecessary waste and spillage of expensive printing ink because of uncontrolled leakage of printing ink, the apparatus has a spray- or shower device 20 disposed adjacent the anilox roll in order, during ongoing operation, to continuously or intermittently spray cleaning fluid for the printing ink on particularly sensitive regions of the circumferential surface of the anilox roll 1. Such a region is the peripheral edge regions of the anilox roll 1 where printing ink in certain cases (in particular printing ink with a high proportion of pigment in relation to solvent) shows a tendency to dry on the anilox roll. Undesirable drying of the printing ink is effectively counteracted with the aid of the applied cleaning fluid which ensures that residual printing ink within these sensitive regions on the surface of the anilox roll is constantly kept in soluble form.

Figure 3:
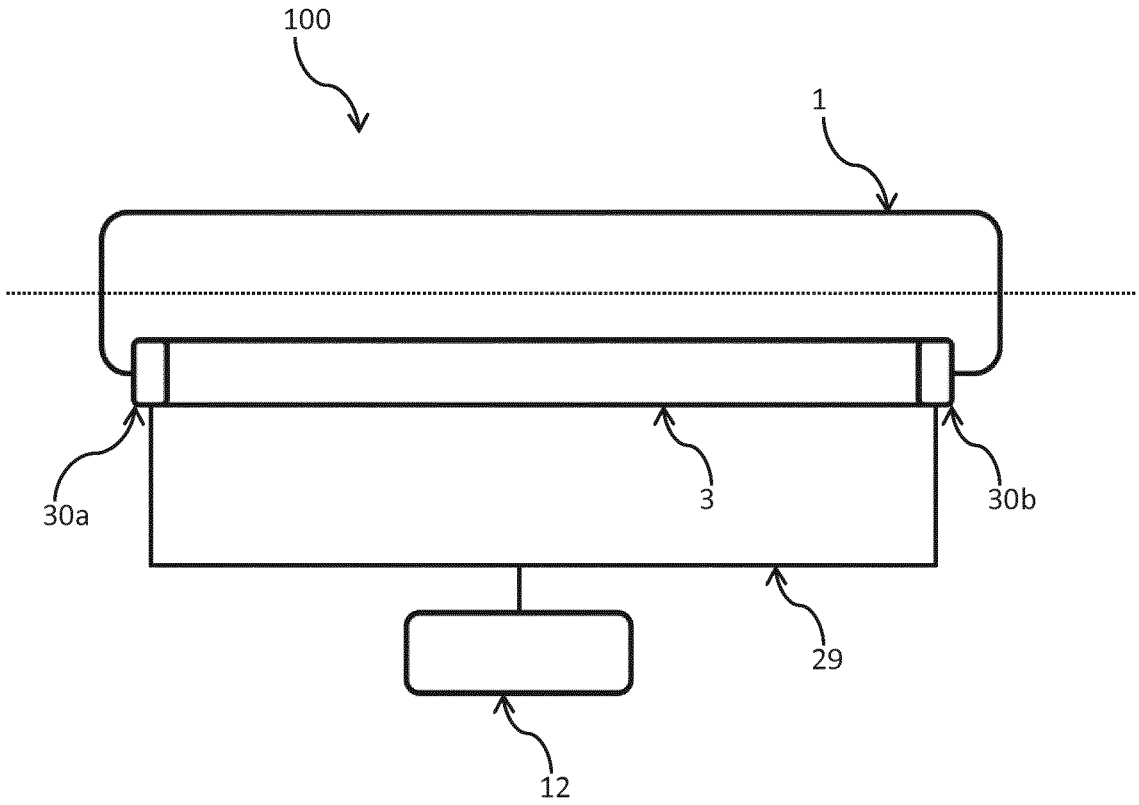
FIG. 3 is a top view of an apparatus according to the present invention.

Now turning to the present invention, FIG. 3 illustrates an apparatus 100 for flexographic printing of a web of packaging material with printing ink. The same reference numerals have been used for the parts and/or components of the apparatus which are the same as in the prior art described in conjunction with FIG. 1 and FIG. 2. The apparatus 100 comprises an ink chamber 3, and an anilox roll 1 rotary at least partly inside the ink chamber 3 for picking up and transferring printing ink from the ink chamber 3 to an impression cylinder (not shown). The impression cylinder is rotary in transfer contact with the anilox roll 1.

The ink chamber 3 is elongated and extends axially along the anilox roll 1. The ink chamber 3 has a first axial end and a second axial end opposite the first axial end. The anilox roll 1 is typically about 0.5 m to 2 m wide. The ink chamber 3, as indicated in FIG. 3, extends shorter than the anilox roll 1. The ink chamber 3 is defined as described in conjunction with FIG. 1, i.e. an upper and a lower doctor blade (not shown), part of the circumferential surface of the anilox roll 1, as well as by an end wall at each respective axial end of the ink chamber 3.

The apparatus 100 further comprises a first printing ink inlet 30*a* arranged at the first axial end of the ink chamber and a second printing ink inlet 30*b* arranged at the second axial end of the ink chamber. The first and second printing ink inlets 30*a*, 30*b* are fluidly connected to an ink reservoir 12 via a conduit 29. The ink reservoir 12 may comprise an ink pump (not shown) for inducing, during operation, a flow of ink from the ink reservoir to the ink chamber 3. Further, the viscosity, temperature and homogeneity of the printing ink may be regulated in the ink reservoir 12. The printing ink inlets 30*a*, 30*b* may form a portion of, or the entire, respective axial end wall of the ink chamber 3.

The first printing ink inlet 30*a* and the second printing ink inlet 30*b* is arranged to direct printing ink at least partly parallel to the axial extent of the anilox roll 1. In other words, the printing ink inlets 30*a*, 30*b* are configured to direct the printing ink towards the center of the ink chamber 3.

The printing ink inlets 30*a*, 30*b* may have an elongated exit, shown more clearly in FIG. 4*a-d*. The elongated exit is elongated in an upright direction, i.e. in the same direction as between the lower and upper doctor blades seen in FIG. 1, to facilitate the construction of a thin ink chamber. The printing ink inlets 30*a*, 30*b* may have entries with the same cross-sectional area as the elongated exits. This reduces the flow restriction caused by the printing ink inlets 30*a*, 30*b*.

As shown in FIG. 3, the printing ink inlets 30*a*, 30*b* are substantially orthogonal and direct a flow of printing ink from the conduit 29 towards the center of the ink chamber 3. This may be provided by each printing ink inlet 30*a*, 30*b* having a channel extending substantially orthogonal between the entry and the elongated exit, illustrated in e.g. FIGS. 4*a*-4*d*.

The printing ink inlets 30*a*, 30*b* may be made of plastic or rubber. The printing ink inlets 30*a*, 30*b* may be formed as inlet modules further described below in conjunction with FIG. 4*a-d*. The printing ink inlets 30*a*, 30*b* formed by inlet modules may be configured to form an anilox roll seal. An anilox roll seal is the viscous seal described in conjunction with FIG. 1, i.e. that a portion of the printing ink inlets 30*a*, 30*b* is disposed such that an edge thereof which faces towards the surface of the anilox roll 1 adheres to the configuration of the anilox roll but at a distance from the circumferential surface of the anilox roll 1. Between the circumferential surface of the anilox roll 1 and the edge of the printing ink inlets 30*a*, 30*b* there is thus a gap which may have a width of from approximately 0.5 mm to approximately 2 mm, preferably from approximately 0.5 mm to approximately 1.5 mm, most preferably from approximately 0.6 to approximately 1.0 mm. Further, an anilox roll seal comprises two mutually spaced apart end wall elements. The end wall element proximal to the ink chamber 3 prevents lateral leakage of printing ink, and the end wall element distal to the ink chamber prevents printing ink having leaked past the proximal end wall element from leaving the ink chamber. A drainage outlet may be arranged between the end wall elements. Hence, printing ink which, where applicable, leaks out laterally from the ink chamber 3 is collected between the end wall elements and may be taken care of via an drainage outlet or the like arranged between the wall elements. The printing ink is thereby prevented from causing splashing and soiling.

In use, the ink pump (not shown) induces a flow of printing ink from the ink reservoir 12 through the conduit to the printing ink inlets 30*a*, 30*b* which inject the printing ink into the ink chamber 3 from the respective axial ends via through the printing ink inlets 30*a*, 30*b*. Thereby, the pressure and flow through the printing ink inlets 30*a*, 30*b* can be reduced compared to e.g. the central inlet of the apparatus in FIG. 1 in order to obtain a homogenous or at least substantially uniform pressure distribution within the ink chamber 3. A substantially uniform pressure distribution in the ink chamber 3 alleviates ink starvation on the anilox roll, in particular towards the lateral portions thereof. The reduced pressure and flow means that there is less frothing. The reduced pressure and flow also means that energy required for the pumping action is reduced.

FIGS. 4*a-d* illustrates an inlet module 30 for a flexographic printing apparatus, such as the apparatuses shown in FIGS. 1, 2 and 3. The inlet module 30 may be made of plastic or rubber. The inlet module 30 is generally L-shaped as seen from the top or bottom.

Figure 4A:
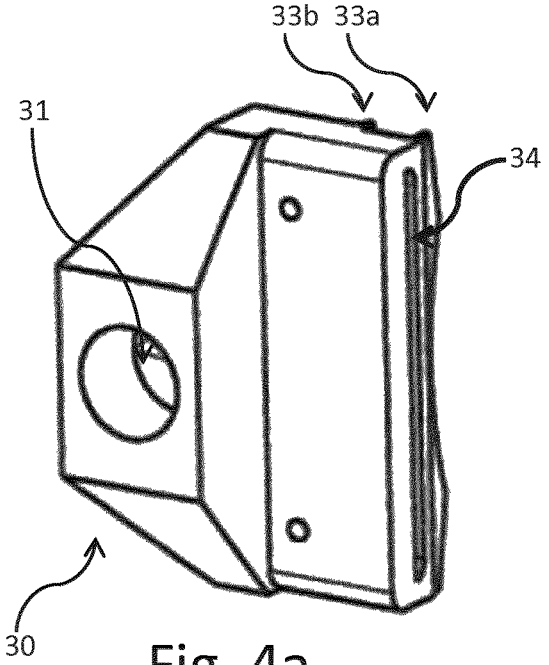
FIG. 4*a-d* are views of an inlet module in accordance with the present invention.
Figure 4B:
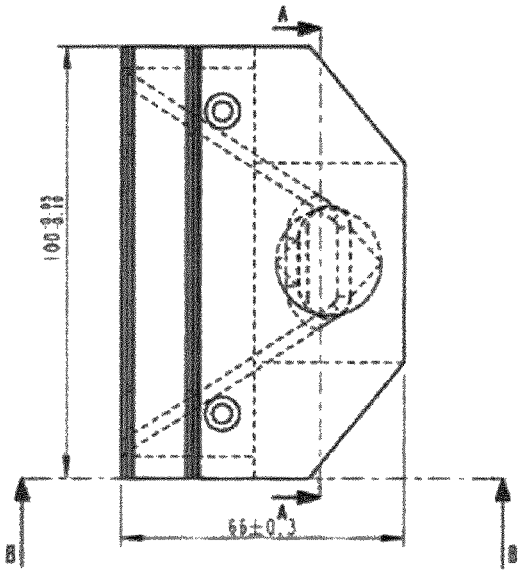
Figure 4C:
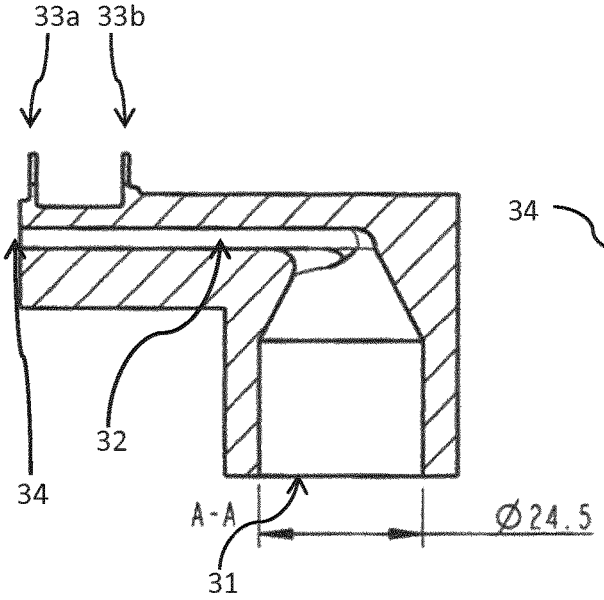
Figure 4D:
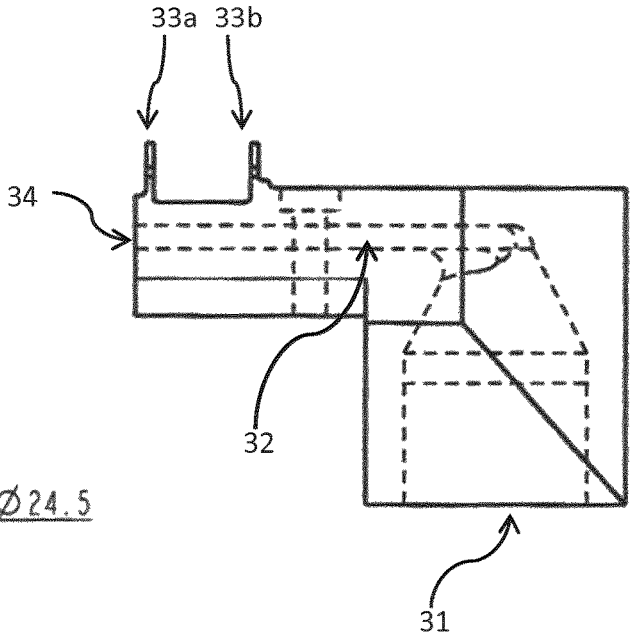

The inlet module 30 comprises a circular entry 31, an elongated exit 34, and a channel 32 extending substantially orthogonally between the entry 31 and exit 34. FIG. 4*c* is a cross-section where the orthogonal channel 32, e.g. a channel having a 90 degree bend is illustrated. The elongated exit 34, and the portion of the inlet module 30 in which the elongated exit 34 is located is the portion which during assembly is inserted into the ink chamber 3 of a flexographic printing apparatus.

The circular entry 31 has the same cross-sectional area as the elongated exit 34. This reduces the flow restriction. FIG. 4*b* shows the transition from the circular entry 31 into the elongated exit 34 having a conical shape. Other shapes or transition are of course possible and within the scope of the invention. The circular entry 31 is adapted to receive and be connected to a conduit from an ink reservoir. The circular entry 31 may have internal or external threads or the like (not shown).

The inlet module 30 further comprises an anilox roll seal formed by two protruding elements 33*a*, 33*b*. The protruding elements 33*a*, 33*b* are two mutually spaced apart axial end wall elements. The edge of the protruding elements 33*a*, 33*b*, when assembled e.g. in the apparatus 100, faces the surface of the anilox roll 1. The width of the gap formed between the anilox roll 1 and the protruding elements 33*a*, 33*b* is 0.5 mm to 2 mm. The protruding element 33*a* closest to the elongated opening 34 is also the proximal protruding element with respect to the ink chamber. During rotation of an anilox roll 1, the proximal protruding element 33*a* prevents the printing ink from leaking laterally past the gap formed between the proximal protruding element 33*a* and the anilox roll. The distal protruding element 33*b* prevents printing ink from leaking out from the ink chamber 3. An ink chamber 3 may further comprise a drainage hole or the like arranged to collect printing ink between the two protruding elements 33*a*, 33*b*.

The first and second printing ink inlets 30*a*, 30*b* discussed above in conjunction with FIG. 3 may be formed in inlet modules as the inlet module shown in FIGS. 4*a-d*.

The invention has mainly been described above with reference to a few embodiments. However, as is readily appreciated by a person skilled in the art, other embodiments than the ones disclosed above are equally possible within the scope of the invention, as defined by the appended patent claims.

The invention claimed is:

1. An apparatus for flexographic printing of a web of packaging material with printing ink, the apparatus comprising:

an ink chamber;

an anilox roll at least partly inside the ink chamber, the anilox roll configured for picking up and transferring printing ink from the ink chamber to an impression cylinder which is in contact with the anilox roll;

wherein the ink chamber is elongated and extends axially along the anilox roll, the ink chamber having a first axial end and a second axial end opposite the first axial end; and wherein the apparatus further comprises a first ink inlet module arranged at the first axial end of the ink chamber and a second ink inlet module arranged at the second axial end of the ink chamber, the first ink inlet module comprising a first entry and a first exit and the second ink inlet module comprising a second entry and a second exit, the first exit facing the second exit, each of the first and second exits facing towards a middle of the ink chamber and configured to direct printing ink towards the middle of the ink chamber, the middle of the ink chamber located between the first and second axial ends of the ink chamber.

2. The apparatus according to claim 1, wherein the first ink inlet module and the second ink inlet module are configured to direct printing ink at least partly parallel to an axial extent of the anilox roll.

3. The apparatus according to claim 1, wherein each of the first and second exits is an elongated exit.

4. The apparatus according to claim 3, wherein the elongated exit is elongated in an upright direction.

5. The apparatus according to claim 3, wherein each of the first and second entries has the same cross-sectional area as the elongated exit.

6. The apparatus according to claim 5, wherein each of the first and second entries is a circular entry and wherein each of the first and second ink inlet modules transition from the circular entry to the elongated exit at a transition region, the transition region having a conical shape.

7. The apparatus according to claim 3, wherein the first ink inlet module comprises a first channel extending substantially orthogonal between the first entry and the first exit and wherein the second ink inlet module comprises a second channel extending substantially orthogonal between the second entry and the second exit.

8. The apparatus according to claim 1, wherein each of the first ink inlet module and the second ink inlet module are substantially orthogonal.

9. The apparatus according to claim 1, wherein each of the first ink inlet module and second ink inlet module further comprise an anilox roll seal.

10. The apparatus according to claim 9, wherein the anilox roll seal comprises two protruding elements, the two protruding elements being spaced apart from one another.

11. The apparatus according to claim 1, further comprising a printing ink reservoir, wherein each of the first ink inlet module and the second ink inlet module is fluidly connected to the printing ink reservoir via a conduit.

12. The apparatus according to claim 11, further comprising a printing ink pump configured to, during operation, pump printing ink from the printing ink reservoir to the first ink inlet module and the second ink inlet module via the conduit.

13. The apparatus according to claim 1, wherein:

the first entry comprises a first cross-sectional area and the first exit comprises a second cross-sectional area, the first entry facing a first direction and the first exit facing a second direction substantially orthogonal to the first direction.

14. The apparatus according to claim 13, wherein:

the second entry comprises a third cross-sectional area and the second exit comprises a fourth cross-sectional area, the second entry facing a third direction and the second exit facing a fourth direction substantially orthogonal to the third direction.

15. The apparatus according to claim 14, wherein:

the first cross-sectional area is equal to the second cross-sectional area and the third cross-sectional area is equal to the fourth cross-sectional area so as to reduce a flow resistance through the first and second ink inlet modules.

16. An inlet module for a flexographic printing apparatus, the inlet module configured for arrangement at a first end of an ink chamber of the flexographic printing apparatus, the inlet module comprising:

a circular entry, the circular entry facing a first direction;

an elongated exit configured for insertion within a portion of the first end of the ink chamber, wherein the elongated exit faces a second direction when inserted into the portion of the first end of the ink chamber, the second direction parallel to a length of the ink chamber and substantially orthogonal to the first direction that the circular entry faces, wherein the elongated exit is configured to direct printing ink toward a middle of the ink chamber, the middle of the ink chamber located between the first end of the ink chamber and a second end of the ink chamber, the second end being opposite of the first end; and a channel extending between the circular entry and the elongated exit;

wherein the inlet module further comprises an anilox roll seal.

17. The inlet module according to claim 16, wherein the circular entry has the same cross-sectional area as the elongated exit.

18. The inlet module according to claim 16, wherein:

the elongated exit comprises a cross-section having a width extending along a first axis and a height extending along a second axis, the height being larger than the width and the first axis being perpendicular the second axis; and the length of the ink chamber extends along a third axis, the third axis being perpendicular to both of the first axis and the second axis.

19. The inlet module according to claim 16, wherein the inlet module transitions from the circular entry to the elongated exit at a transition region, the transition region having a conical shape.

* * * * *